United States Patent [19]

Tirtiaux et al.

[11] 4,411,806

[45] Oct. 25, 1983

[54] ANTIFOAM ADDITIVES

[75] Inventors: Robert Tirtiaux; Alain L. P. Lenack, both of Mont Saint Aignan, France

[73] Assignee: Exxon Research & Engineering Co., Florham Park, N.J.

[21] Appl. No.: 243,594

[22] Filed: Mar. 13, 1981

[30] Foreign Application Priority Data

Mar. 26, 1980 [GB] United Kingdom ..... 8010189

[51] Int. Cl.[3] ..... C10M 1/22

[52] U.S. Cl. ..... 252/49.6; 252/42.7; 252/33.4; 252/358

[58] Field of Search ..... 252/49.6, 42.7, 33.4, 252/358

[56] References Cited

U.S. PATENT DOCUMENTS

| | | | |
|---|---|---|---|
| 2,416,504 | 2/1947 | Trautman et al. | 252/49.6 |
| 2,813,077 | 11/1957 | Rogers et al. | 252/33.4 |
| 2,813,077 | 1/1957 | Rogers et al. | 252/33.4 |
| 3,024,194 | 3/1962 | Francis et al. | 252/49.6 |
| 3,024,194 | 3/1962 | Francis et al. | 252/49.6 |
| 3,660,305 | 5/1972 | Michalski | 252/321 |

OTHER PUBLICATIONS

"The Science of Petroleum" Dunstan et al., vol. II, 1938, pp. 1401, 1402, 1403, 1404.

*Primary Examiner*—Charles F. Warren
*Assistant Examiner*—Y. Harris-Smith
*Attorney, Agent, or Firm*—Frank T. Johmann

[57] ABSTRACT

Improved dispersion of silicone antifoams in lubricating compositions is achieved by dissolving the antifoam in an alkyl aromatic hydrocarbon of molecular weight below 330 and with a flash point above 140° C.

7 Claims, No Drawings

ANTIFOAM ADDITIVES

The present invention relates to improvements in antifoam additives for lubricants and especially to improving the dispersion of the antifoam in a bulk lubricating oil as well as improving the effectiveness of the antifoamant.

Antifoam additives are incorporated into automotive crankcase lubricants to reduce the tendency of the oil to foam during operation of the engine. The foaming tendency is enhanced by the presence of other additives such as surfactants especially the normal or highly basic metal sulphonates and phenates in the oil, such as the overbased calcium and magnesium sulphonate detergent additives.

The use of silicone antifoam agents in lubricating oil compositions is well known in the art. Representative disclosures are U.S. Pat. No. 3,660,305 and issued May 2, 1972 to Michalski; and U.S. Pat. No. 3,024,194 issued Mar. 6, 1962 to Francis et al and U.S. Pat. No. 2,813,077 issued Nov. 12, 1957 to Rogers et al. The prior art recognises however that there are problems in providing effective dispersions or solutions of such silicone antifoam agents in lubricating oils. Thus, U.S. Pat. No. 3,660,305 recommends combining silicone with an acetylenic alcohol to improve dispersability in oil. Beerbower et al in "Lubricating Engineering", June, 1961, pages 282–285, show the desirability of providing high intensity mixing to stabilize the silicone in a lubricating oil. Volatile solvents such as benzene, toluene or xylene have also been used as suitable media but these require distillation techniques to remove the solvent from the lubricating oil.

In accordance with the present invention there is provided an improved silicon antifoam composition which is readily dispersable or miscible with lubricating oils which comprises a 1–10% by weight solution of a polydimethylsiloxane of the formula $(CH_3)_3Si(SiO(CH_3)_2)_nOSi(CH_3)_3$ where n is an integer to provide a viscosity of about 1,000 to 60,000 centistokes at 25° C. in an alkyl aromatic hydrocarbon solvent being a mono- or polyalkylated benzene having a molecular weight of about 220 to 330 and a flash point greater than 140° C.

The silicone antifoam agents with which the present invention is concerned may be any of the well known silicones. Examples include those sold by Dow Corning under the trade name "Dow Corning 200 Fluid"—which are the fluid antifoam additives of the polymethylsiloxane type, in which the viscosity at 25° C. can vary from 1,000 to 60,000 cSt according to the polycondensation degree, may be used. Preferred is a viscosity range of about 10,000 to 50,000 cSt.

We have found that these silicones which are traditionally used as antifoamants for lubricants dissolve readily in the alkylaromatic solvents and that these solutions may be dispersed in bulk lubricating oil without impairing the performance of the lubricant. Suitable alkyl aromatic solvents generally include mono- and polyalkylated benzene compounds which have a molecular weight of about 220 to 330 and a flash point (ASTM D92, Cleveland Open Cup) of about 140° C. to 180° C. The preferred solvents are polypropyl benzenes which distill between 290° and 330° C. These compounds are by-products of the manufacture of the heavy alkylates used in the production of detergents. A particular preferred solvent is a polypropyl benzene of molecular weight 280 and a flash point of 140° C. We find that if an alkyl aromatic of molecular weight above 330 is used then it is not possible to obtain a clear solution of the silicone. If however the alkyl aromatic has a flash point below 140° C. it is necessary to distill off the solvent to retain the desirable properties of the lubricant. The flash point therefore should be between 140° C. and 180° C.

The typical silicones are soluble in all proportions in the alkyl aromatic hydrocarbons but we prefer to dissolve from 2 to 8 weight percent silicone in the solvent since this concentration allows accurate metering of the small quantities of antifoam needed in the bulk lubricant. Generally from 0.005to 0.5% of the antifoam based on the weight of the fully formulated lubricant composition is sufficient. We have found that the use of the composition of the present invention also enables especially potent antifoaming formulations to be obtained.

Therefore a further embodiment of the present invention resides in lubricating oil compositions, especially lubricating oil compositions containing a metal detergent oil soluble normal or basic sulfonate or phenate additive, such as the calcium or magnesium sulfonates or phenates, which has reduced foaming tendencies through addition of 0.005 to 0.5% by weight of the polydimethylsiloxane antifoam agent said antifoam agent being added to the lubricating oil composition in the form of a 1 to 10% by weight solution in the alkyl aromatic hydrocarbon solvent being a mono- or polyalkylated benzene having a molecular weight of about 220 to 330 and a flash point greater than 140° C.

Such lubricating oil compositions will normally contain other conventional additives in such amounts as to provide their normal attendant functions such as dispersants, viscosity index improvers, anti-wear additives, antioxidants and the like in addition to the metal detergent additives noted above.

The present invention is illustrated but in no way limited by reference to the following Examples. In these Examples the foaming is measured on an oil of lubricating viscosity containing 2 wt % of a 300 Total Base Number Calcium Sulphonate according to the foam test ASTM D 892. Metal detergent sulphonates are known to promote the foaming tendencies of lubricating oils and for that reason the test is conducted with oils containing sulphonates. The antifoam agent was the silicone sold by Dow Corning under the trade name "DC200" having a 12,500 cSt viscosity and various concentrations were incorporated in the lubricant by the following three techniques:

(a) Dispersion directly in the oil under high shear conditions at 100° C. for 30 minutes.

(b) The antifoam was dissolved to provide a clear stable solution by shaking at room temperature at a concentration of 4 wt percent in polypropyl benzene of molecular weight 280, flash point 140° C., relative density at 15° C. of 0.855 and a kinematic viscosity at 40° C. of 8 cSt. This solution was readily miscible with lubricating oils.

(c) The antifoam was dissolved in toluene as per (b) but it was necessary to remove the toluene by distillation at 150° C.

The results which show foam height in ml. after 5 minutes and 10 minutes were as follows:

| Addition Technique | (a) | (b) | (c) |
|---|---|---|---|
| Antifoam Content in | | | |

-continued

| Addition Technique | (a) | (b) | (c) |
|---|---|---|---|
| Product A | | | |
| 200 ppm | 60/10 | 20/0 | — |
| 100 ppm | 120/20 | 50/10 | 50/10 |
| 50 ppm | 200/50 | 70/20 | — |
| The value without antifoam was 250/120. | | | |

What is claimed is:

1. An improved silicone antifoam composition for lubricating oils which comprises a solution of about 1 to 10% by weight of polydimethylsiloxane of the formula $(CH_3)_3Si(SiO(CH_3)_2)_nOSi(CH_3)_3$ wherein n is an integer to provide a viscosity of about 1,000 to 60,000 cSt at 25° C. in an alkylaromatic hydrocarbon solvent, said solvent being a mono- or polyalkylated benzene having a molecular weight of about 220 to 330; a Cleveland Open Cup flash point of about 140° C. to about 180° C., and boiling between about 290° to about 330° C., said composition exhibiting improved solubility in a lubricating oil composition.

2. The composition of claim 1 wherein the alkyl aromatic hydrocarbon solvent is a polypropyl benzene.

3. The composition of claim 2 wherein the polypropyl benzene has a molecular weight of about 280 and a flash point of about 140° C.

4. The composition of claim 1 wherein the polydimethylsiloxane has a viscosity of about 10,000 to 20,000 centistokes at 25° C.

5. The composition of claim 1 wherein the concentration of said solution is about 2 to 10 weight percent.

6. A method of preparing a mineral lubricating oil composition with reduced foaming tendencies by adding thereto the composition of claim 1 in an amount sufficient to incorporate about 0.005 to 0.5 wt. % of said polydimethylsiloxane.

7. A method of preparing the lubricating oil composition of claim 6 wherein said composition further contains a metal detergent additive being a normal or basic calcium or magnesium sulfonate or phenate.

* * * * *